US006317930B1

(12) United States Patent
Hung

(10) Patent No.: US 6,317,930 B1
(45) Date of Patent: Nov. 20, 2001

(54) PIVOTAL DEVICE OF A HANDLE

(75) Inventor: Michael Hung, Tao Yuan County (TW)

(73) Assignee: MVP (H.K.) Industries Limited, North Point (HK)

( * ) Notice: Subject to any disclaimer, the term of this patent is extended or adjusted under 35 U.S.C. 154(b) by 0 days.

(21) Appl. No.: 09/339,203

(22) Filed: Jun. 24, 1999

(51) Int. Cl.[7] ..... B25G 3/00

(52) U.S. Cl. ..... 16/430; 16/436; 403/94; 403/97

(58) Field of Search ..... 403/97, 94, 92; 16/430, 436, 438, 900; 74/55.1–551.8

(56) References Cited

U.S. PATENT DOCUMENTS

| | | | | |
|---|---|---|---|---|
| 4,614,452 | * | 9/1986 | Wang | 403/97 |
| 5,301,570 | * | 4/1994 | Li | 403/97 |
| 5,356,237 | * | 10/1994 | Sung | 403/92 |
| 5,515,744 | * | 5/1996 | Liao | 403/97 |
| 5,830,047 | | 11/1998 | McCracken . | |

* cited by examiner

*Primary Examiner*—Anthony Knight
*Assistant Examiner*—Enoch E Peavey
(74) *Attorney, Agent, or Firm*—Bacon & Thomas, PLLC

(57) ABSTRACT

A pivotal handle may be adjusted and maintained at a desired angle by manipulating a pair of movable pieces at opposite ends of the handle to permit engagement and disengagement of toothed portions on the ends of the handle and corresponding toothed portions on a pair of fixing seats.

4 Claims, 5 Drawing Sheets

PIVOTAL DEVICE OF A HANDLE

FIELD OF THE INVENTION

The present invention relates to a pivotal device of a handle, and especially to a pivotal device capable of changing the orientation of a handle, thus the handle can be installed to various products. Since the orientation of the handle is adjustable, it may be suitable for different requirement. Therefore, the user may use the product with the handle comfortably.

BACKGROUND OF THE INVENTION

In a prior art handle used in various products, for example, the handle of a waxing machine or handle of a health running machine, or handle of a bicycle, etc. The object of installing the handle is that a user may conveniently handle the product. However, the prior art handle is directly installed to a specific product. Thus, the user must meet the specific angle of the handle so as to suit the product. The user can not change the orientation of the handle with the requirement or demand himself (or herself). In fact, maybe some orientations of the handles are matched with the requirement of ergonomics. However, since everybody has its habit or pose, the conventional design often can not suit the requirement of everyone. Therefore, there is an eager demand for a handle the orientation of which is adjustable as desired.

SUMMARY OF THE INVENTION

Accordingly, the primary object of the present invention is to provide a pivotal device of a handle. By a movable piece at one side of the handle, the handle is rotatable. Thus, the user may adjust the handle to a desired orientation. Then, the movable piece is pushed back to a preset position. Thus, the handle is fixed in a predetermined angle. Therefore, it is suitable for the habit of the user and the user may use the product comfortably and conveniently.

Another object of the present invention is to provide a pivotal device of a handle. The handle can be made as a cambered rod, two ends of which are installed with the pivotal device. Therefore, the handle can be installed at a waxing machine or other proper products so that the user may adjust the handle as desired. Accordingly, a preferred force applied angle is obtained and the waxing machine or other product is used conveniently.

The various objects and advantages of the present invention will be more readily understood from the following detailed description when read in conjunction with the appended drawing.

DETAILED DESCRIPTION OF THE PREFERRED EMBODIMENTS

Figure 1:
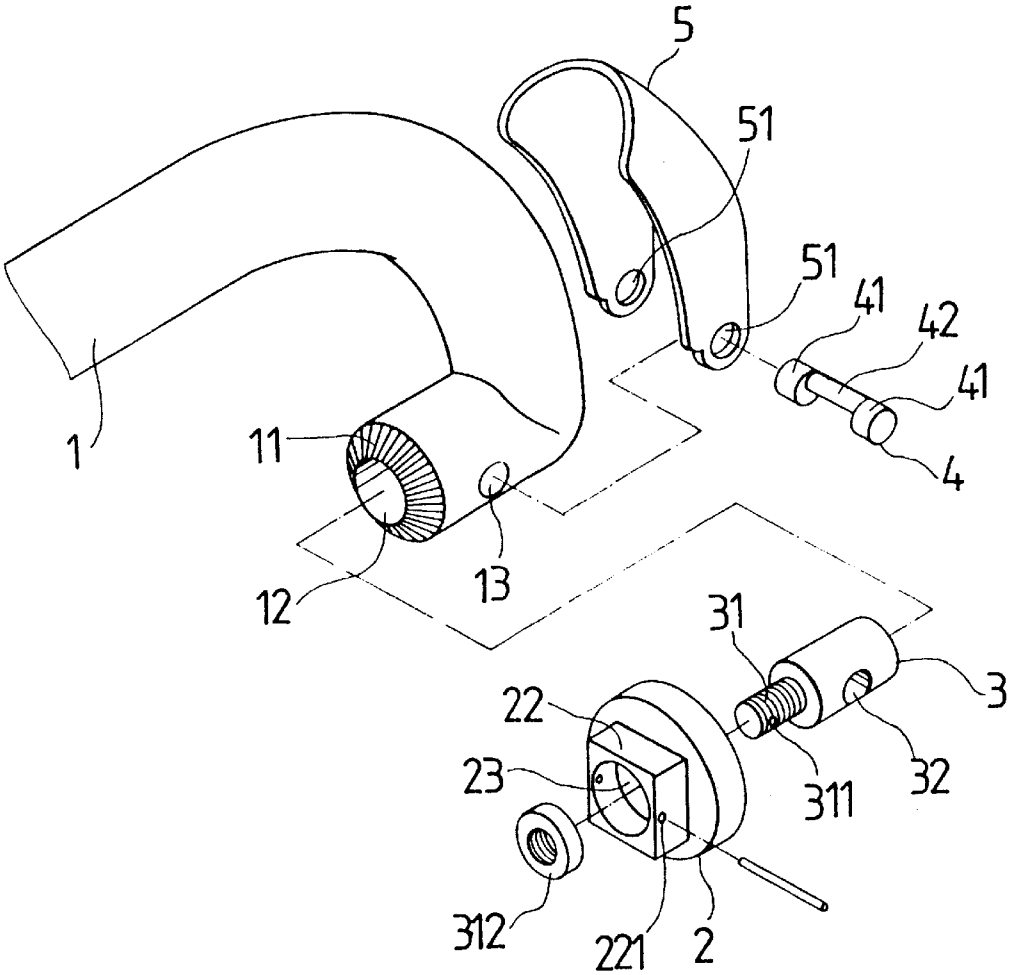
FIG. 1 is a perspective view of the present invention.

As shown in FIG. 1, the pivotal device of a handle according to the present invention includes a handle 1, a fixing seat 2, a supporting shaft 3, an eccentric shaft 4 and a movable piece 5, etc.

The handle 1 is a rod shape handle, and the end portion thereof is formed with a protruded umbrella shape teeth portion 11. The teeth thereof have a triangular shape. An axial through hole 12 is formed at the center of the umbrella shape teeth portion 11. One side of the handle 1 has a pivotal hole 13 penetrating through the handle 1 so that the pivotal hole 13 is communicated with the through hole 12.

Figure 2:
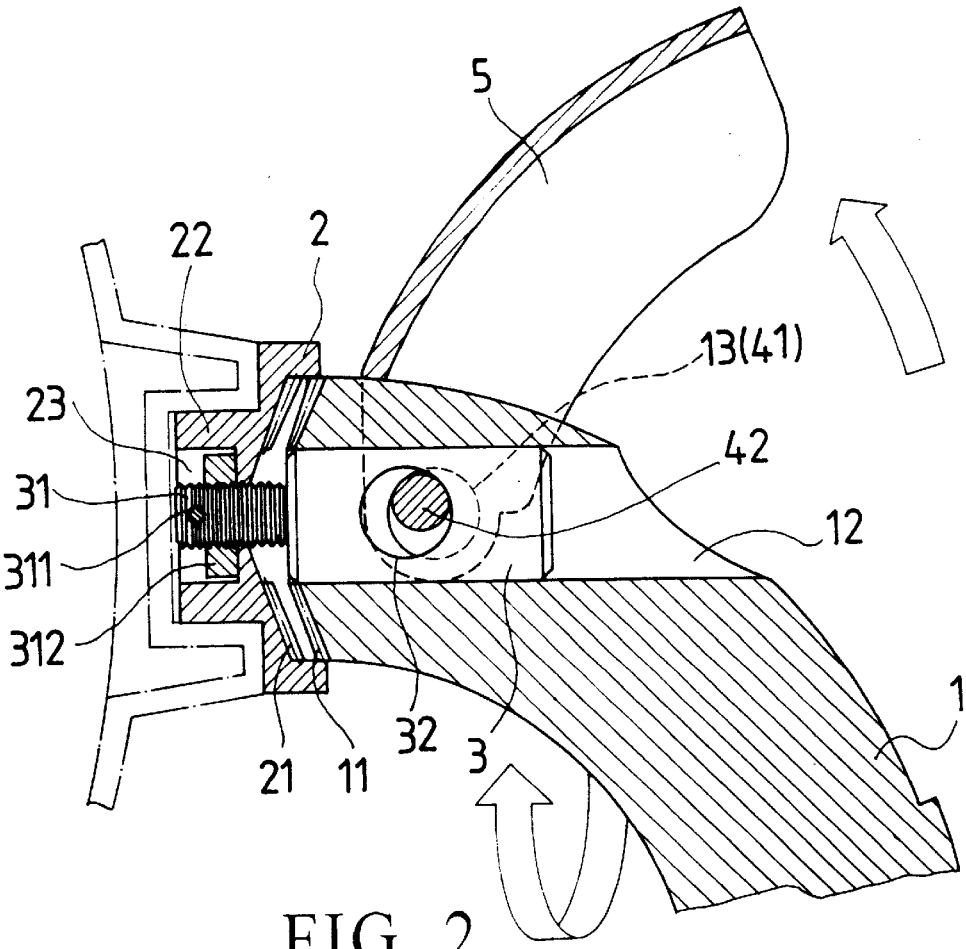
FIG. 2 is a schematic cross sectional view showing the action of the present invention.

A fixing seat 2 (as shown in FIGS. 1 and 2) is a cylindrical base. A concave umbrella shape teeth portion 21 is formed in the center of the front surface thereof. The teeth of the umbrella shape teeth portion 21 have a triangular shape. The rear surface of the fixing seat 2 has a rectangular post 22. One side of the rectangular post 22 is installed with a pin hole 221 radially penetrated. A staged hole 23 is installed in the center of the fixing seat 2.

The supporting shaft 3 is a cylindrical rod. One end thereof has a thread section the side of which is formed with a pin hole 311. The lateral surface of the cylindrical rod is a radial through hole 32. The diameter of the through hole 32 is identical to the pivotal hole 13 of the handle 1.

The eccentric shaft 4 is a cylindrical shaft 41, and an eccentric section 42 with a smaller diameter is installed in the center thereof. The outer diameter of the eccentric shaft 42 is tangent to the cylindrical shaft 41 for forming an eccentric circular shaft.

The movable piece 5 is a cambered piece so that the cross section thereof has a U shape. The distal ends on the two lateral walls of the movable pieces are installed with respective pivotal hole 51 so that the two pivotal holes are opposite to one another.

Figure 3:
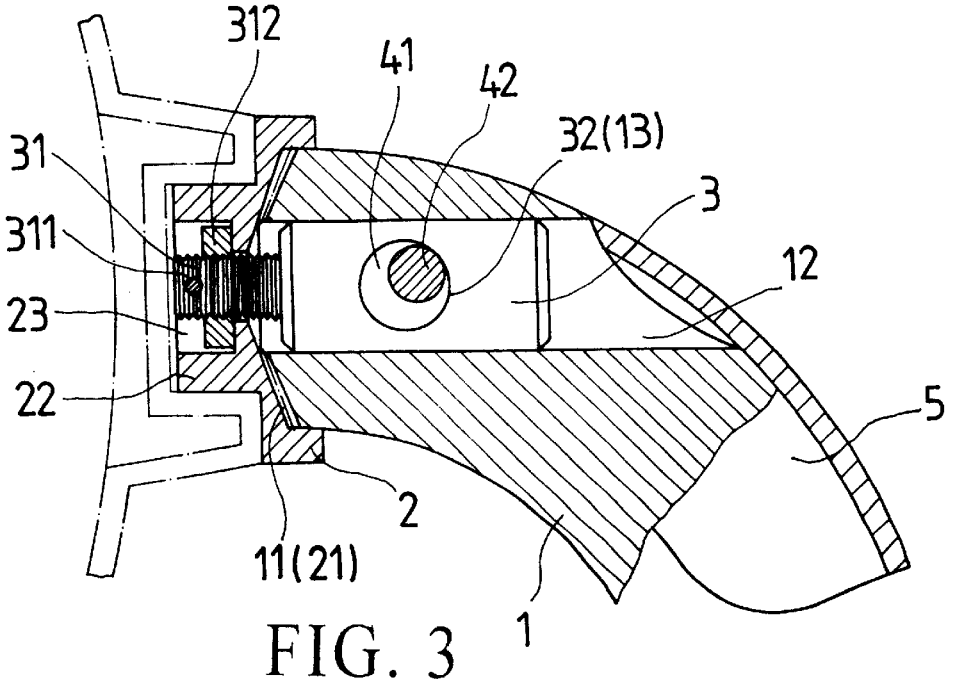
FIG. 3 is a schematic cross sectional view of the present invention.

By the aforementioned components (as shown in FIGS. 1 and 3), the thread section 31 of the supporting shaft 3 is inserted into the staged hole 23 of the fixing seat 2 and is screwedly installed to the screw section 31 from the rear side of the fixing seat 2 by a nut 312. The supporting shaft 3 is firmly secured to the central portion of the fixing seat 2. Then, the front end of the supporting shaft 3 is inserted into the through hole 12 of the handle 1 so that the umbrella shape teeth portion 11 of the handle 1 are engaged with the umbrella shape teeth portion 21 of the fixing seat 2. Since the through hole 32 of the supporting shaft 3 is aligned to the pivotal hole 13 of the handle 1, the eccentric shaft 4 will pass through the pivotal hole 13 and the through hole 32. By the pivotal holes 51 of the movable pieces 5 at two ends of the cylindrical shaft 41 of the eccentric shaft 3 are pivotally connected to one side of the handle 1 . However, since the eccentric section 42 of the eccentric shaft 4 is exactly positioned in the through hole 32 of the supporting shaft 3. Thus, it will eject against the wall of the through hole 32 with an angle. The two umbrella shape teeth portions 11 and 12 are engaged tightly, then the pivotal device of a handle is formed by assembling the aforementioned components.

Figure 5:
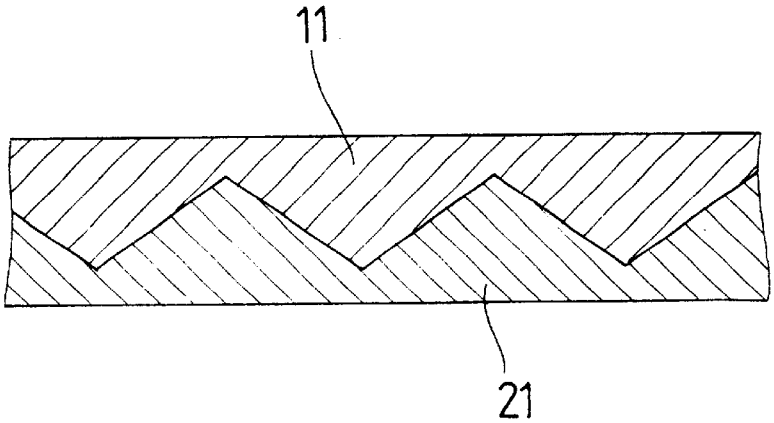
FIG. 5 is a schematic view showing the engaging state of the present invention.

If the handle 1 is in a state for rotatably adjusting the fixing angle. When the movable pieces 5 push away the handle 1 (as shown in FIG. 2), the eccentric shaft 4 is driven to rotate to a predetermined angle such that the distal end of the eccentric section 42 will eject against the front hole wall of the through hole 32. Thus, the handle 1 may be directly pushed away, and by the intermittent engagement of the umbrella shape teeth 11 of the triangular teeth (as shown in FIG. 5), the angle is adjusted. In other words, although the two umbrella shape teeth portions 11 and 21 are engaged, the handle 1 can be rotated by the elasticity of the plastic. However, when the movable piece 5 is pushed back to a predetermined position (as shown in FIG. 3), the eccentric section 42 of the eccentric shaft 4 will eject against the front wall of the through hole 32 of the supporting shaft 3 so that the handle 1 can not be compressed due to elasticity and thus rotate. Therefore, it is fixed to a specific angle. Alternatively, by the pivotal device of a handle formed by assembling the aforementioned components, the orientation of the handle can be adjusted freely.

Figure 4:
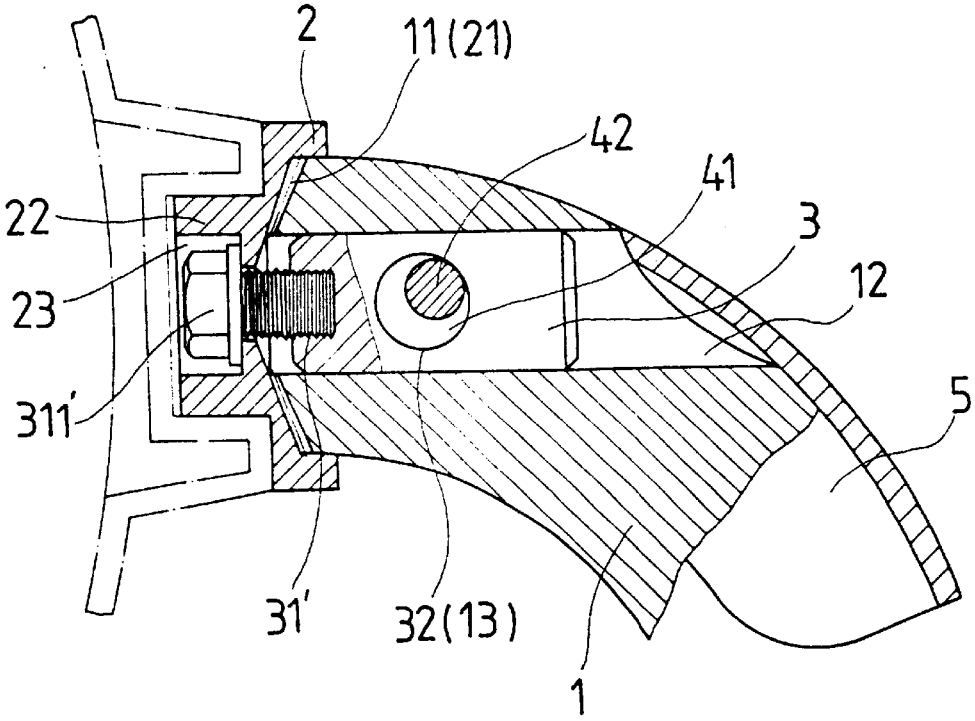
FIG. 4 is a schematic cross sectional view of another embodiment according to the present invention.

Moreover, the way for the supporting shaft 3 of the present invention to be firmly secured to the fixing seat 2 is not confined to the structure of the aforesaid thread section 31, as shown in FIG. 4. The distal end of the supporting shaft 3 may be installed with a screw hole 31'. Thereby, after the supporting shaft 3 is located within the center portion of the fixing seat 2. A stud 311' can be used to be screwedly locked into the screw hole 31' from the rear side of the fixing seat 2. Thus, the supporting shaft 3 and the fixing seat 2 are combined steadily.

Figure 6:
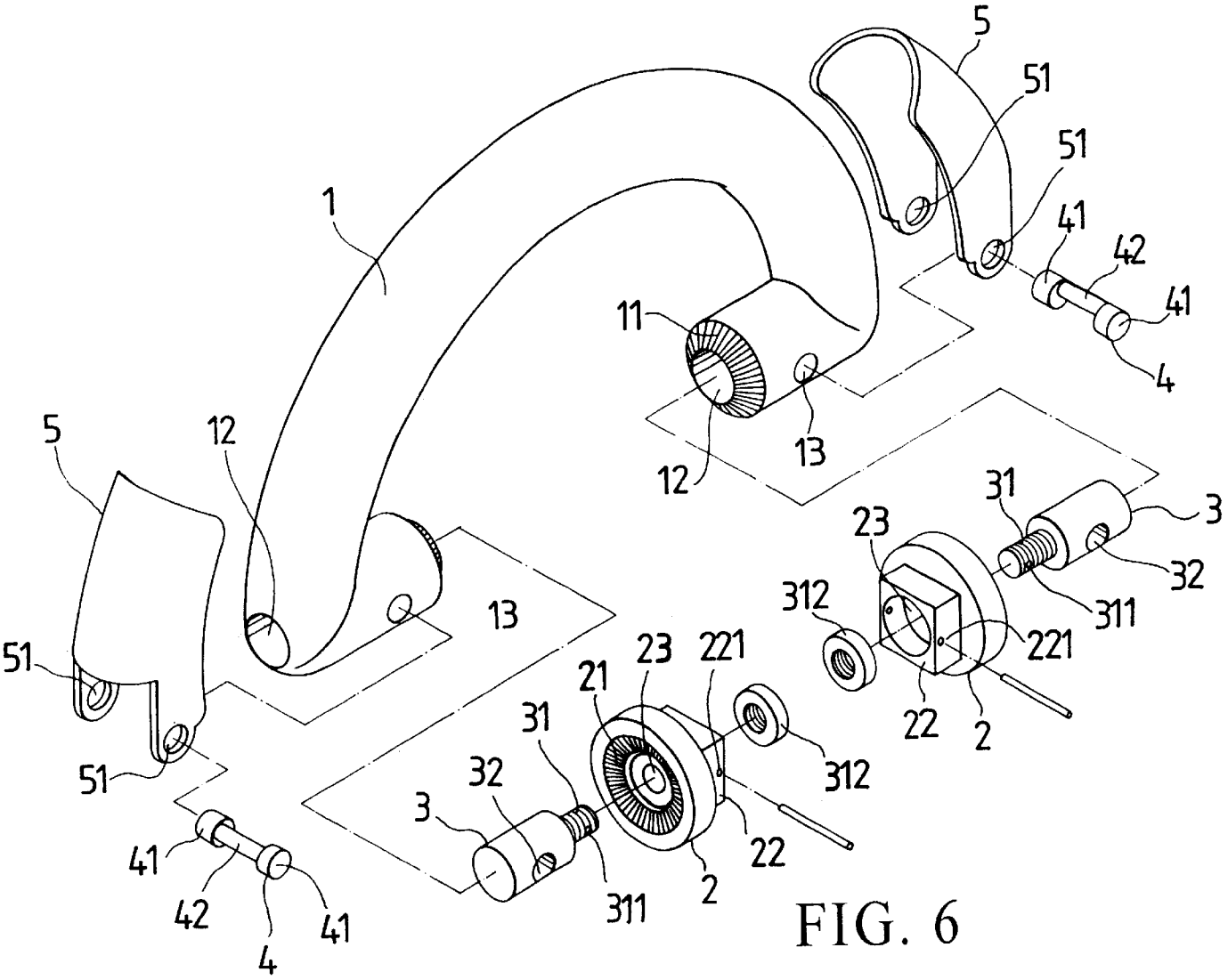
FIG. 6 is an exploded perspective view of the U shape handle of the present invention.
Figure 7:
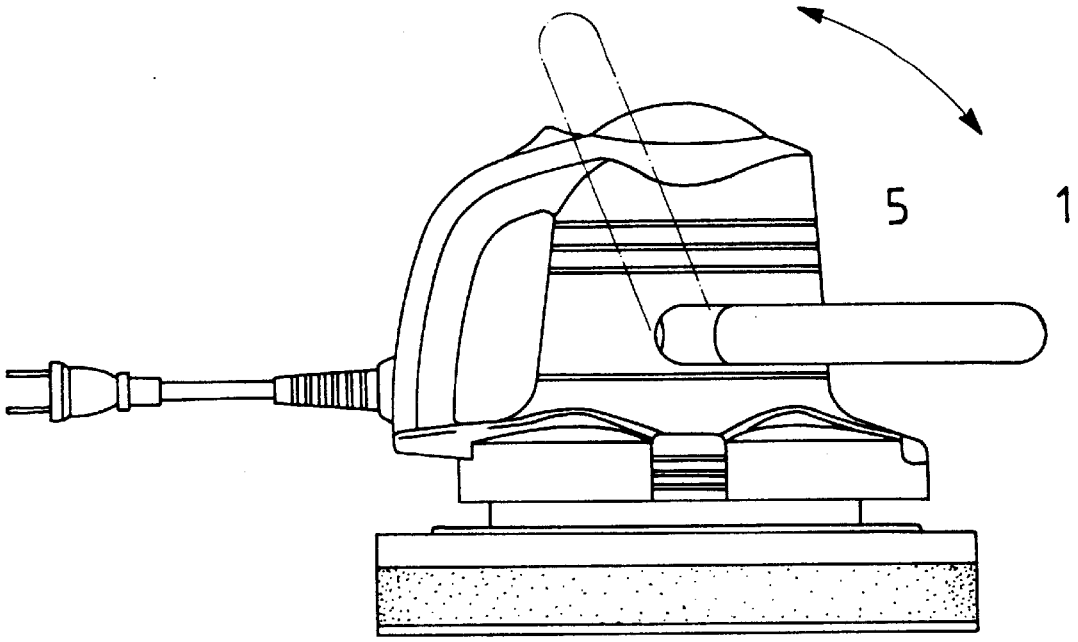
FIG. 7 is a lateral view showing that the present invention is applied to a waxing machine.
Figure 8:
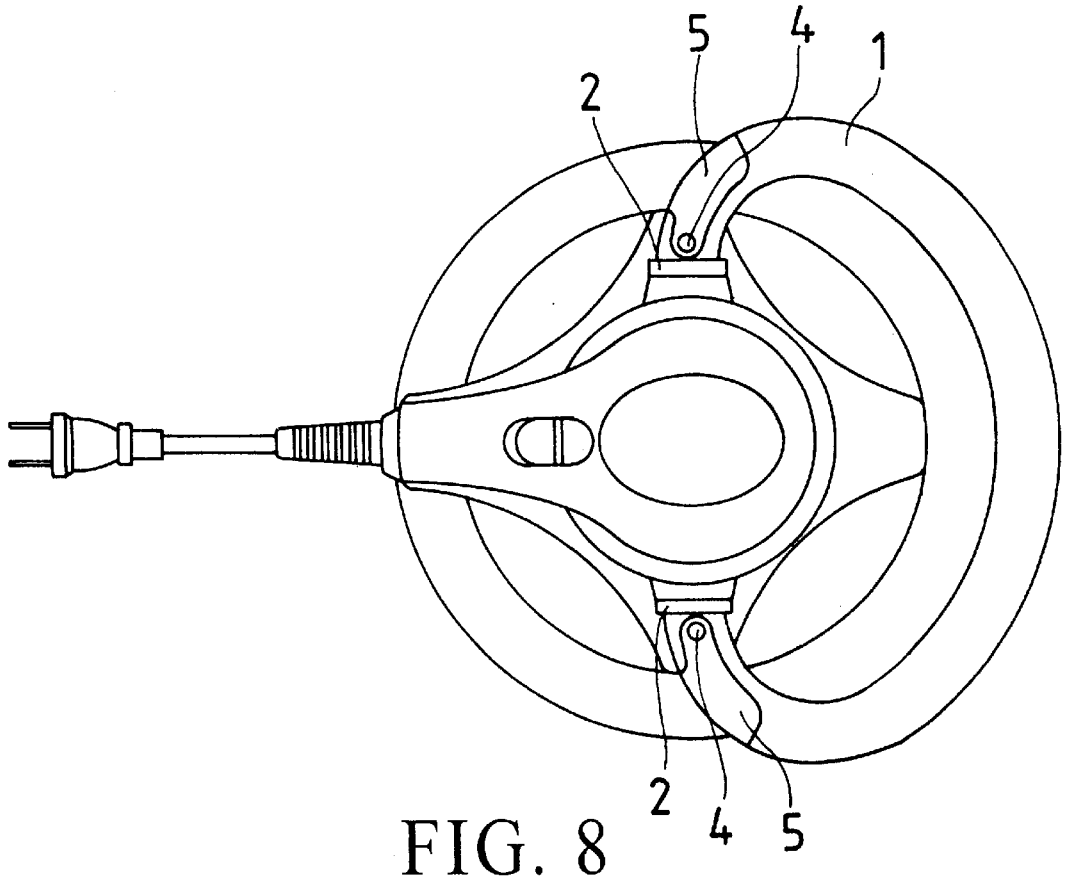
FIG. 8 is an upper view showing that the present invention is applied to a waxing machine.

The pivotal device of a handle of the present invention can be installed at any products. As shown in FIGS. 6~8, the handle may be have a U shape, while two ends thereof are installed with correspondent umbrella shape teeth portions. Thus, the fixing seat 2 are firmly secured to the two sides of a waxing machine 10 by the rectangular post 22 thereof. Then, the two umbrella shape teeth portions of handle 1 are pivotally installed to the waxing machine 10. Therefore, as a user desires to operate the waxing machine, he (or she) may operate by holding the handle 1. However, since everyone has different habit in using and operating, thus he may adjust the handle to a preferred orientation, and then fix the handle 1 so that the user may operate the waxing machine in a comfortable way. Similarly, the embodiment of the present invention does not be confined to be used to a waxing machine. All products with handles are suitable to be used with the present invention, and by the pivotal device of a handle of the present invention, it can be adjusted freely.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A pivotal device and handle assembly comprising a handle, a fixing seat, a supporting shaft, an eccentric shaft, and a movable piece, wherein the end portion of the handle is formed with a protruded umbrella shape teeth portion, an axial through hole is formed at the center of the umbrella shape teeth portion, one side of the handle has a handle pivotal hole penetrating through the handle so that the handle pivotal hole communicates with the through hole;

the fixing seat is a cylindrical seat having a concave umbrella shape teeth portion formed in the center of a front surface thereof, a rear surface of the fixing seat has a rectangular post, and one side of the rectangular post is provided with a pin hole and a penetrated staged hole is provided in a center of the fixing seat;

the supporting shaft is a cylindrical rod, one end thereof has a thread section, the lateral surface of the cylindrical rod has a radial through hole, the diameter of the through hole is identical to the diameter of the handle pivotal hole;

the eccentric shaft is a cylindrical shaft, and an eccentric section with a smaller diameter is provided in a center thereof, the outer diameter of the eccentric shaft is tangent to the cylindrical shaft for forming an eccentric circular shaft;

the movable piece is a cambered piece so that the cross section thereof has a U shape, the distal ends on two lateral walls of the movable piece are each provided with a respective piece pivotal hole so that the two piece pivotal holes are opposite to one another; and wherein, the thread section of the supporting shaft is inserted into the staged hole of the fixing seat; the supporting shaft is firmly secured to the central portion of the fixing seat; the front end of the supporting shaft is inserted into the through hole of the handle so that the umbrella shape teeth of the handle are engaged with the umbrella shape teeth of the fixing seat; the through hole of the supporting shaft is aligned to the handle pivotal hole, the eccentric shaft will pass through the handle pivotal hole and the through hole, by the cylindrical shaft of the eccentric shaft, the movable piece is pivotally connected to one side of the handle; and since the eccentric section of the eccentric shaft is exactly positioned in the through hole of the supporting shaft, it will eject against the wall of the through hole at an angle therewith and cause the two umbrella shape teeth portions to be tightly engaged together.

2. The pivotal device and handle assembly as claimed in claim 1, wherein a tooth of the umbrella shape teeth portion at the end portion of the handle has a triangular shape, and a tooth of the umbrella shape teeth portion at the front surface of the fixing seat has a corresponding triangular shape.

3. The pivotal device and handle assembly as claimed in claim 1, wherein the thread section of the supporting shaft is inserted into a central portion of the fixing seat, and a nut is engaged on the thread section.

4. The pivotal device of a handle as claimed in claim 1, wherein one end of the supporting shaft is provided with a screw hole, the supporting shaft is installed at a rear side of a center of the fixing seat, and a stud is locked into the screw hole from the fixing seat for assembling the supporting shaft and the fixing seat together.

* * * * *